US009751744B2

(12) United States Patent
Grottini

(10) Patent No.: US 9,751,744 B2
(45) Date of Patent: Sep. 5, 2017

(54) COMBINATION OF DISPENSER AND CONTAINER WITH SYSTEM FOR THE CORRECT PLACING AND IDENTIFICATION OF THE CONTAINER

(71) Applicant: BLUPURA S.R.L., Loreto (IT)

(72) Inventor: Gianni Grottini, Porto Recanati (IT)

(73) Assignee: BLUPURA S.R.L., Loreto (IT)

( * ) Notice: Subject to any disclaimer, the term of this patent is extended or adjusted under 35 U.S.C. 154(b) by 0 days.

(21) Appl. No.: 14/763,021

(22) PCT Filed: Sep. 3, 2014

(86) PCT No.: PCT/IB2014/001736

§ 371 (c)(1),
(2) Date: Jul. 23, 2015

(87) PCT Pub. No.: WO2015/044730

PCT Pub. Date: Apr. 2, 2015

(65) Prior Publication Data

US 2016/0207754 A1 Jul. 21, 2016

(30) Foreign Application Priority Data

Sep. 26, 2013 (IT) ..... AN2013A0174
Mar. 28, 2014 (IT) ..... AN20140025 U
(Continued)

(51) Int. Cl.
*B65B 1/30* (2006.01)
*B67D 1/08* (2006.01)
*B67D 3/00* (2006.01)

(52) U.S. Cl.
CPC ..... *B67D 1/0888* (2013.01); *B67D 1/0801* (2013.01); *B67D 1/0894* (2013.01);
(Continued)

(58) Field of Classification Search
CPC .. B67D 3/0006; B67D 1/0888; B67D 1/0801; B67D 1/0894; B67D 2210/00031; B65D 2303/00
See application file for complete search history.

(56) References Cited

U.S. PATENT DOCUMENTS 4,504,153 A * 3/1985 Schollmeyer ..... A61J 7/0481 221/2
4,929,818 A * 5/1990 Bradbury ..... B67D 1/0014 235/375
(Continued)

FOREIGN PATENT DOCUMENTS

DE 9309192 8/1993
DE 202006004151 6/2006
(Continued)

OTHER PUBLICATIONS

Specifications of related PCT Patent Application PCT/IB2014/001737, titled "Combination of Dispenser and Container for a Plurality of Containers, Having a System for the Correct Placing" co-owned by applicant, and for which U.S. Appl. No. 14/763,154, was filed concurrently with the present application.

*Primary Examiner* — Paul R Durand
*Assistant Examiner* — Randall Gruby
(74) *Attorney, Agent, or Firm* — Shalom Wertsberger; Saltamar Innovations

(57) ABSTRACT

The object of the present invention is the combination between a dispenser (1) for dispensing beverages and a container (5) intended to be used in the drawing station (2) of said dispenser (1). Said dispenser (1) and container (5) are provided each with a centring element (4, 6) having reciprocal shape, the coupling thereof enables the positioning of said container (5) inside the compartment (3) of the drawing station (2) of said dispenser (1), in such a way that the mouth (5.2) of said container (5) is vertically aligned with the
(Continued)

overlying opening or spout (3.3) for dispensing the beverages. The reciprocal coupling between said centring elements (4, 6) further activates a wireless communication system for the exchange of data between said container (5) and said dispenser (1).

23 Claims, 7 Drawing Sheets

(30) Foreign Application Priority Data

Mar. 28, 2014 (IT) ..... AN20140026 U
Mar. 28, 2014 (IT) ..... AN20140027 U

(52) U.S. Cl.
CPC ..... *B67D 3/0006* (2013.01); *B65D 2303/00* (2013.01); *B67D 2001/0811* (2013.01); *B67D 2001/0812* (2013.01); *B67D 2210/00031* (2013.01)

(56) References Cited

U.S. PATENT DOCUMENTS 5,682,930 A 11/1997 Crossdale
5,738,153 A * 4/1998 Gerling ..... A01M 7/0092 137/552
6,335,907 B1 * 1/2002 Momich ..... A61J 7/0481 221/15
6,564,999 B1 * 5/2003 Saveliev ..... B65D 25/205 222/52
6,578,763 B1 * 6/2003 Brown ..... B67D 7/02 222/129.1
6,761,318 B2 * 7/2004 Dudek ..... B65B 57/02 235/487
6,968,876 B2 * 11/2005 Yacko ..... B67D 1/124 141/104
7,571,586 B1 * 8/2009 Morales ..... B08B 9/28 53/167
7,617,850 B1 11/2009 Dorney
7,621,426 B2 * 11/2009 Reynolds ..... A47K 5/1217 116/205
7,624,922 B2 * 12/2009 Brown ..... B67D 7/02 235/381
7,654,421 B2 * 2/2010 Chan ..... A47L 15/4418 222/52
7,702,419 B2 * 4/2010 Kinalski ..... B41J 2/17509 347/7
8,176,948 B2 * 5/2012 Carrig ..... H04W 4/08 141/21
8,245,739 B1 8/2012 Wade
2003/0051767 A1 * 3/2003 Coccaro ..... B65D 1/02 141/351
2003/0051945 A1 * 3/2003 Coccaro ..... B65D 23/008 186/52
2004/0129723 A1 7/2004 Meder et al.
2005/0099304 A1 * 5/2005 Humphrey ..... G06Q 20/204 340/572.8
2007/0215239 A1 * 9/2007 Dorney ..... A47G 19/2227 141/94
2007/0222619 A1 * 9/2007 Moran ..... G01F 1/075 340/573.1
2009/0001177 A1 * 1/2009 Smith ..... G06Q 20/10 235/494
2009/0205747 A1 * 8/2009 Lillard, Jr. ..... B67D 1/0888 141/94
2010/0024913 A1 * 2/2010 Howard ..... B65D 1/0223 141/1
2010/0024915 A1 * 2/2010 Thomas ..... A47L 13/50 141/69
2010/0200110 A1 8/2010 Segiet
2011/0000923 A1 * 1/2011 Morales ..... B67D 7/02 220/673
2012/0103926 A1 * 5/2012 Ibsies ..... B65B 3/04 215/228
2012/0227860 A1 * 9/2012 Jeremiah ..... B65D 1/0292 141/1

FOREIGN PATENT DOCUMENTS

EP 1424651 6/2004
WO WO2004/056695 7/2004
WO WO2010/138114 12/2010

* cited by examiner

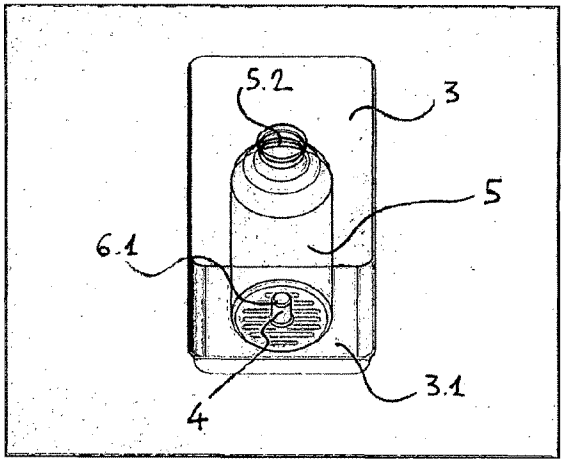
Fig. 4.A
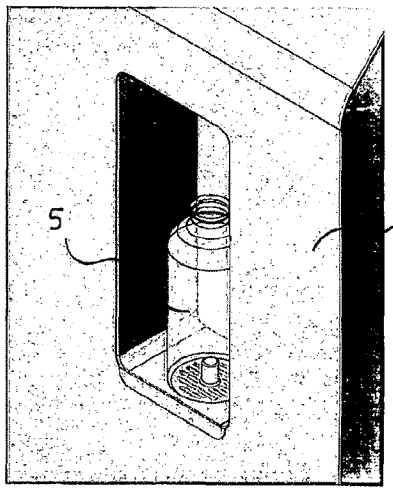
Fig. 4.B
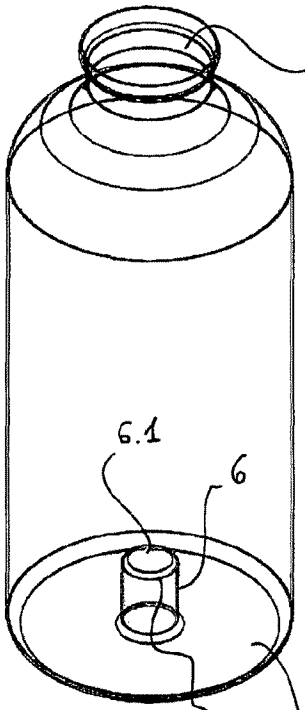
Fig. 3.A
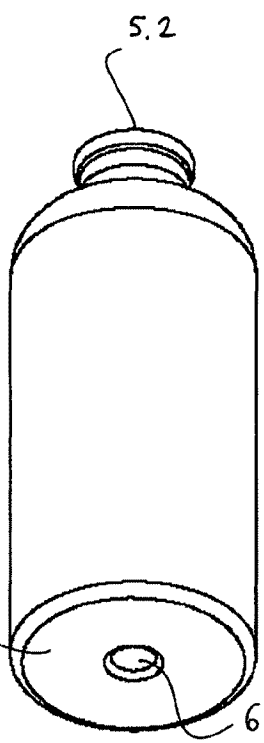
Fig. 3.B

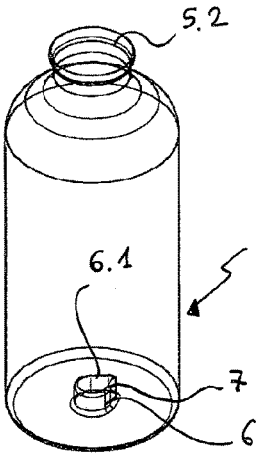
Fig. 5.A
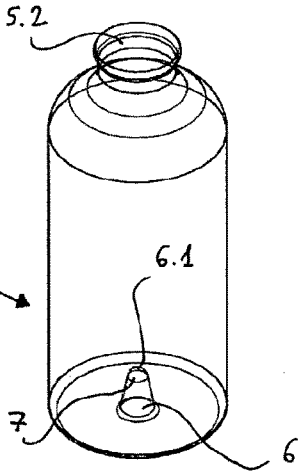
Fig. 5.B
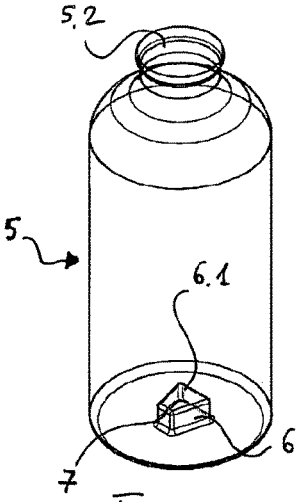
Fig. 5.C
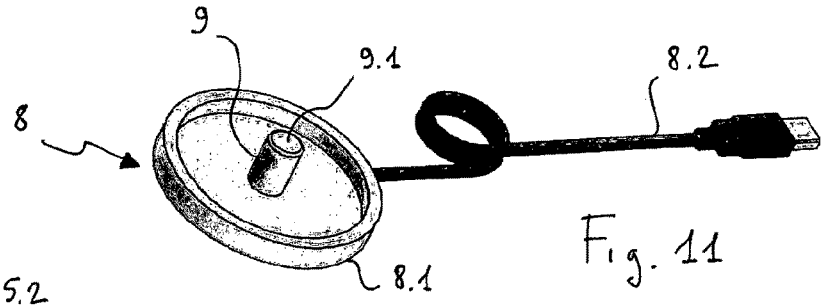
Fig. 11
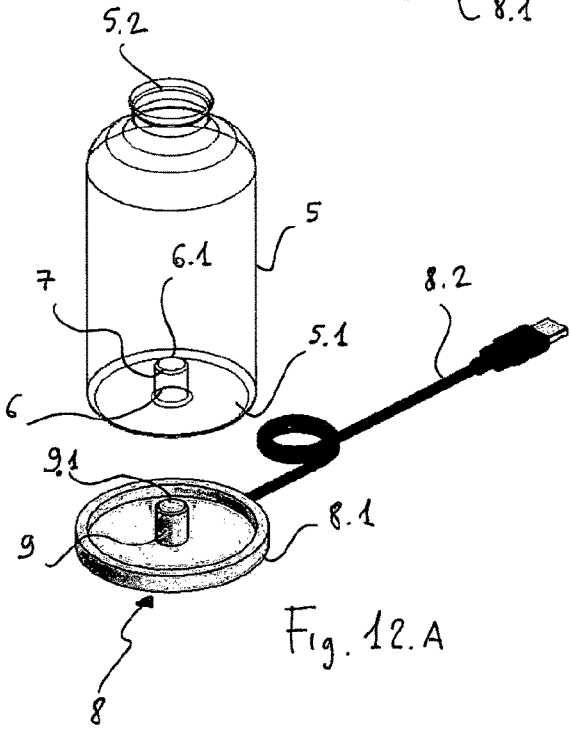
Fig. 12.A
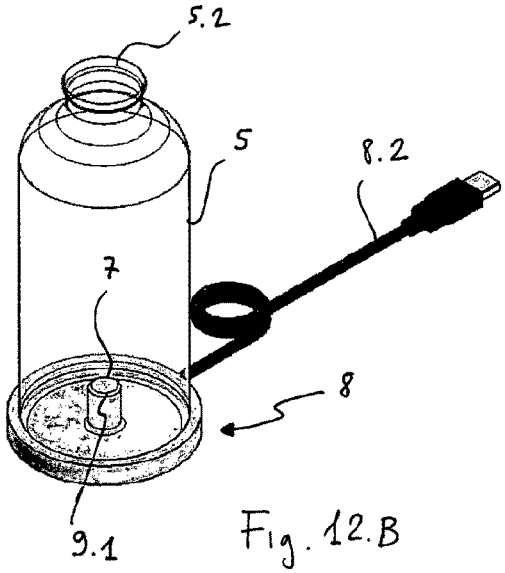
Fig. 12.B

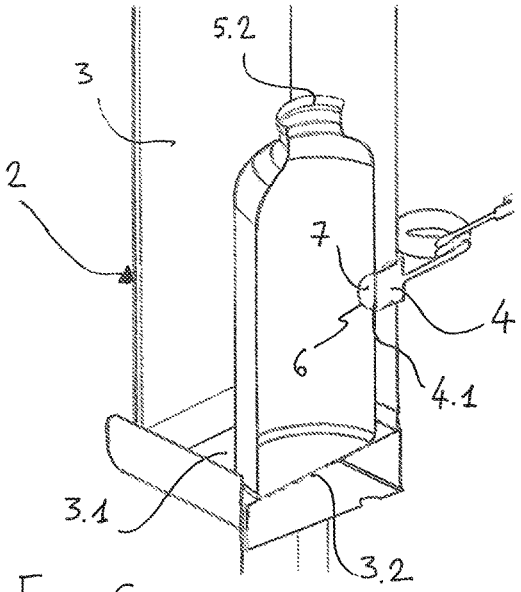
Fig. 6.A
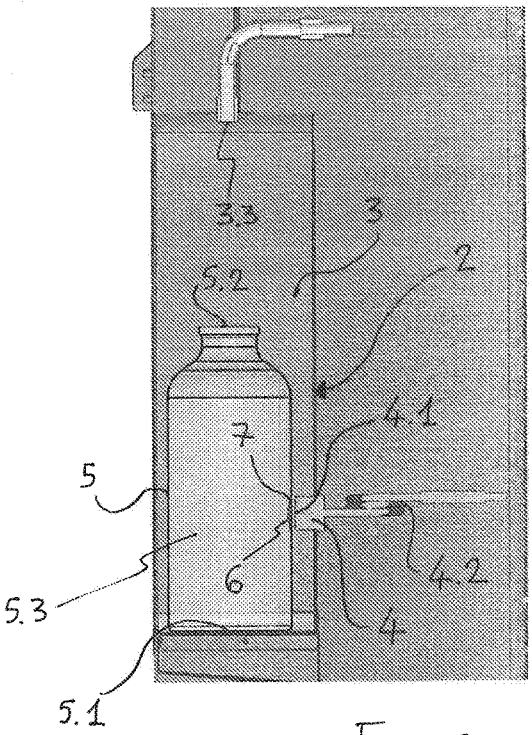
Fig. 6.B
Fig. 7
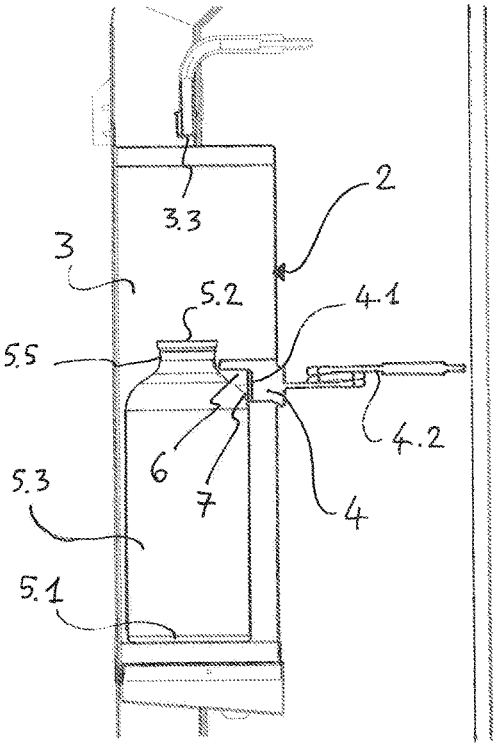
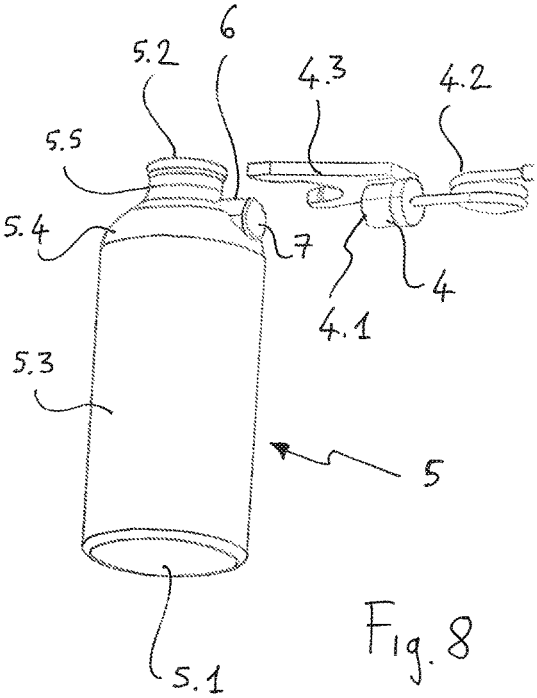
Fig. 8

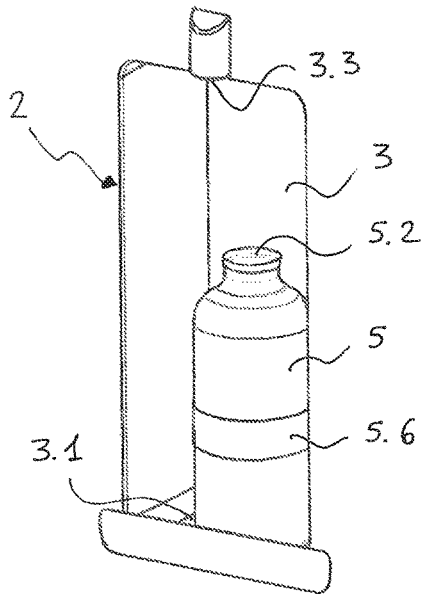
Fig. 9.A
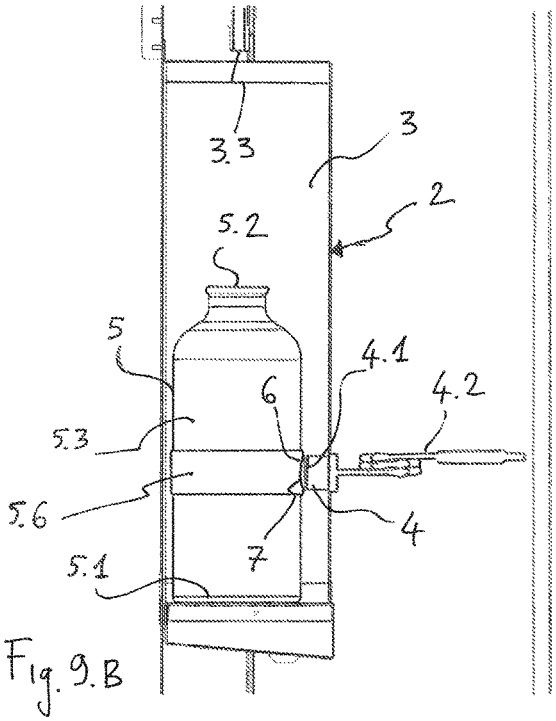
Fig. 9.B
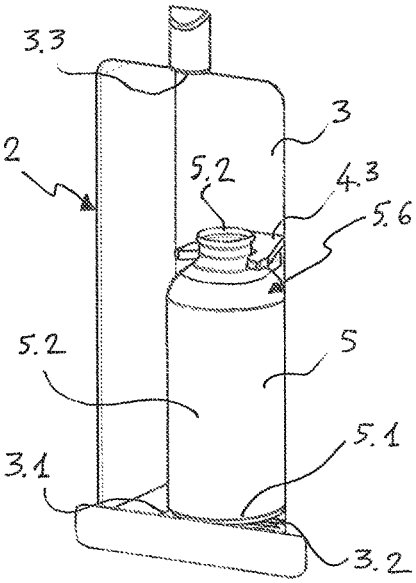
Fig. 10.A
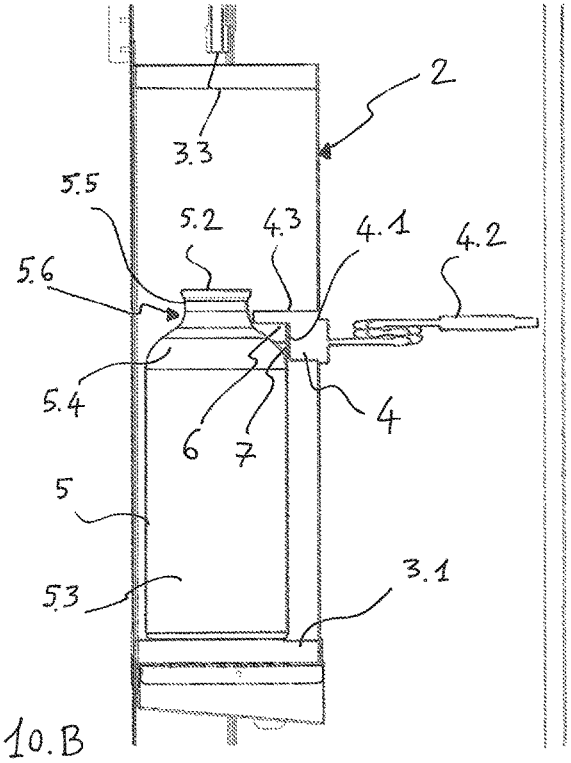
Fig. 10.B

COMBINATION OF DISPENSER AND CONTAINER WITH SYSTEM FOR THE CORRECT PLACING AND IDENTIFICATION OF THE CONTAINER

The present invention relates to a machinery for supplying and dispensing drinking water and beverages in general, provided with means for the correct positioning of the container for beverages and with a system adapted to recognise such container for exchanging data with said dispenser.

Recently, dispensers (a term that shall be used hereinafter to identify a generic "beverage dispensing equipment") suitable for use in public places and outdoor (and for this reason also referred as "public fountain") in addition to the usual household, work and public catering environments (hotels, canteens, restaurants, bars and communities).

Said dispensers have constructive and functional features that are now standardized, whereof it is not necessary to dwell too much.

In the present description, suffice it to say that the dispenser requires the connection to the aqueduct water mains and/or to storage tanks, and is capable of supplying drinking water and/or beverages (after purification, where necessary, with known filtering means and/or bacteria purification units) at room and/or refrigerated (through known refrigeration means) temperature and/or carbonated (through the addition of carbon dioxide).

The dispenser is then provided with at least one drawing station to access the beverage dispensing spout (whereunder the single container to be filled or the case with multiple containers to be filled may be placed) and suitable controls to start the dispensing function, typically comprising at least a currency acceptance device (or suitable prepaid card) and at least one push-button panel adapted to select the drawing station, the type of beverage dispensed and its quantity.

The dispenser may also be provided with additional accessories for an improved user experience, such as audio-visual means for broadcasting multimedia content, typically oriented to the broadcasting of advertising messages or to the display of the instructions for using the public fountain. By way of example, reference shall be made to Patents No. US 2004129723 and DE 202006004151, both describing a water dispenser provided with a monitor to display audio-visual content.

A drawback of the prior art dispensers lies in the lack of systems for guiding the user to a simple and quick dispensing of the beverage in the container, the above at the expense of speed of use and waste of the beverage, events to be absolutely limited, especially for those dispensers installed in public places.

The object of the present invention is to provide a combination between a dispenser and a container with reciprocal means for a correct and precise allocation of the container inside the drawing point of the dispenser.

Another object of the present invention is to provide a container having an identification system communicating with the dispenser, such as to allow an improved experience of use to the user.

A further object of the present invention is to provide means to ease and automate the dispensing function of the beverage inside the container by the drawing station of the dispenser.

Further features of the present invention shall be better highlighted by the following description of a preferred embodiment, in accordance with the patent claims and illustrated in the enclosed designs. Such figures should be considered as having an illustrative and non-limiting purpose, in which:

Figure 2:
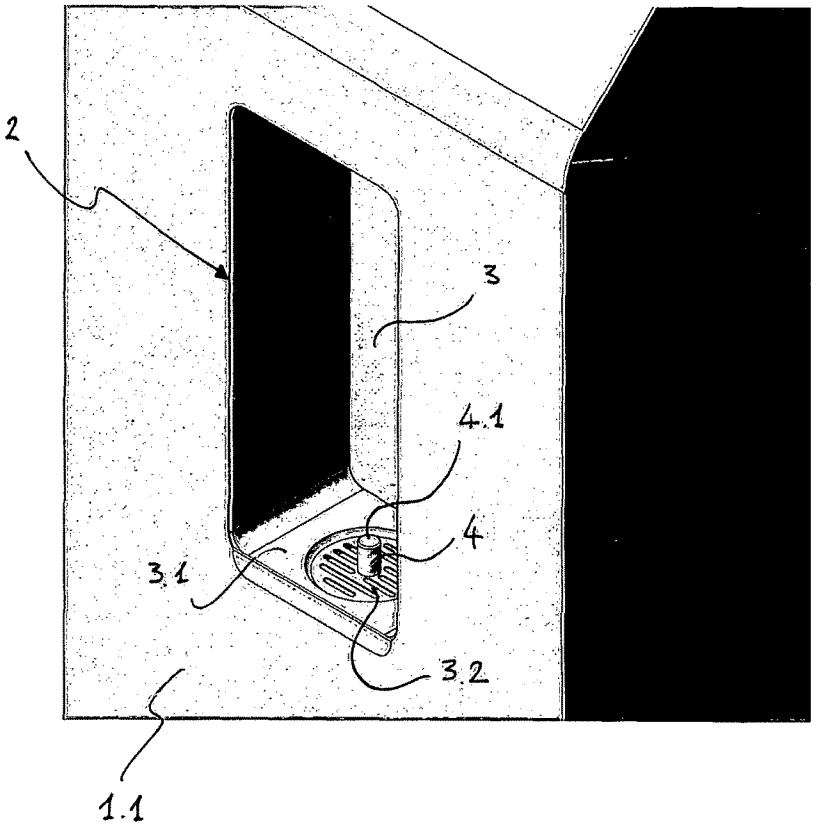
FIG. 2 shows a detail of the drawing station of the dispenser of FIG. 1
Figure 1:
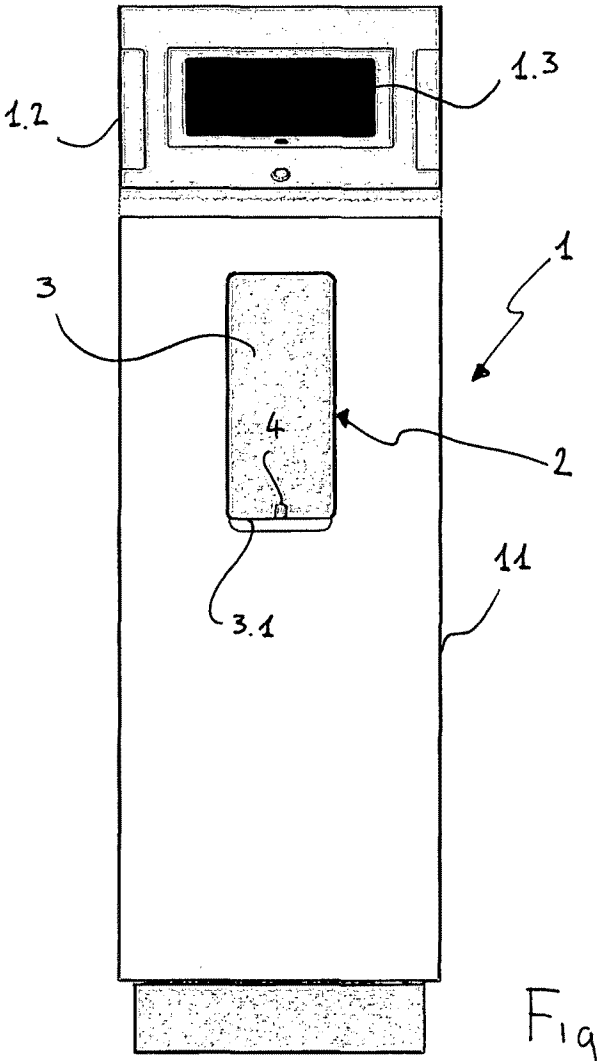
FIG. 1 shows a front view of the dispenser according to a first variant of the invention.
Figure 13:
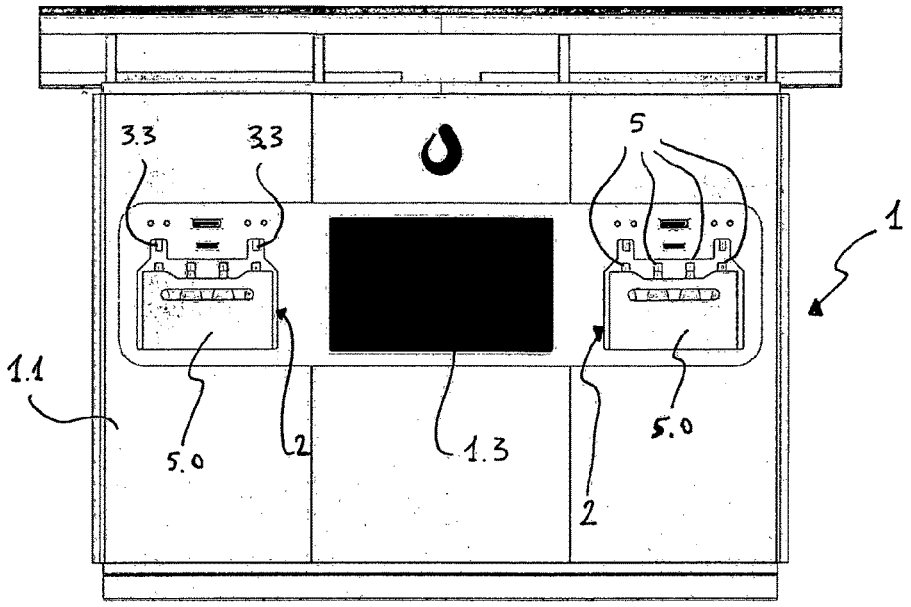
Figure 14:
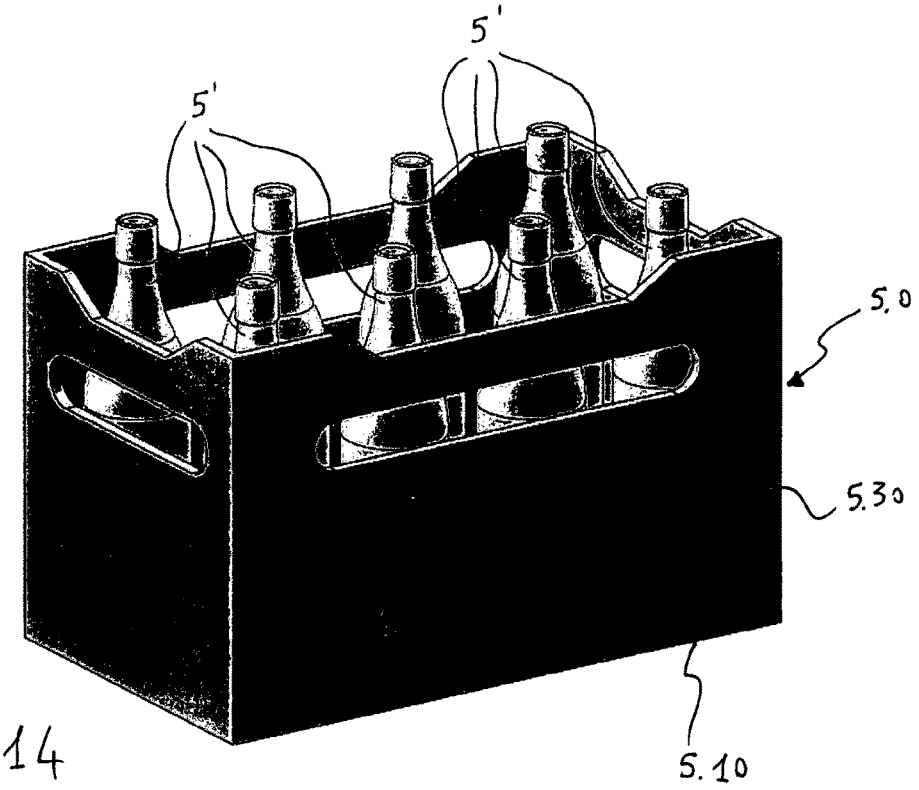
Figure 15:
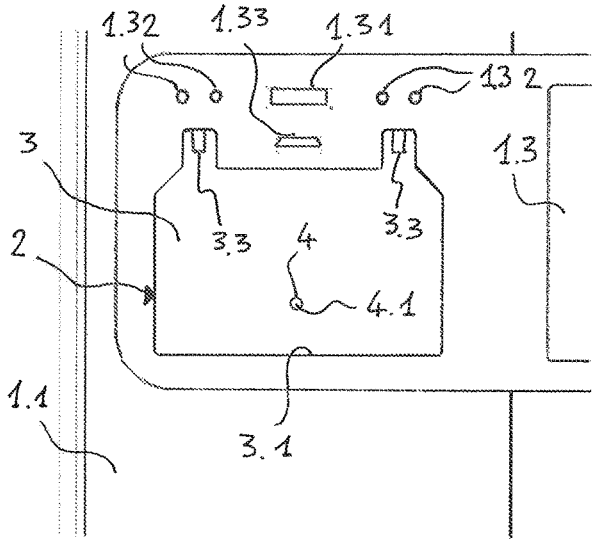

FIGS. 3.A and 3.B are two views of a variant of the container usable in combination with the dispenser of FIG. 1, respectively according to the substantially front-top and front-bottom perspectives;

FIGS. 4.A and 4.B show, respectively according to a front view and a side perspective, the container of FIGS. 3.A and 3.B placed in the drawing station of the dispenser of FIG. 1;

FIGS. 5.A, 5.B and 5.C show three further variants of a container usable in combination with as many variants of the dispenser of FIG. 1;

FIGS. 6.A and 6.B show, respectively, a section detail and a side view of the drawing station of a further variant of the dispenser of FIG. 1;

FIG. 7 is a side view of the drawing station of the dispenser and container according to a further variant of the invention;

FIG. 8 shows a detail of the coupling system between the drawing station of the dispenser and the container in accordance with the variant of FIG. 7;

FIGS. 9.A and 9.B show respectively a perspective front-side detail and a side view of a variant of the container placed in the dispenser according to a variant of the invention;

FIGS. 10.A and 10.B show respectively a perspective front-side detail and a side view of another variant of the container placed in the dispenser according to a further variant of the invention;

FIG. 11 shows a portable device for reading/writing of the system associated to the container usable with the dispenser according to the invention;

FIGS. 12.A and 12.B illustrate the steps of insertion of the container in the device of FIG. 11;

FIG. 13 shows a front view of the dispenser according to another variant of the invention;

FIG. 14 shows a case of the plurality of containers, usable with the dispenser shown in FIG. 13;

FIG. 15 is a detail of the drawing station of the dispenser of FIG. 13, whereon the case of the plurality of containers of FIG. 14 can be used.

Figure 16:
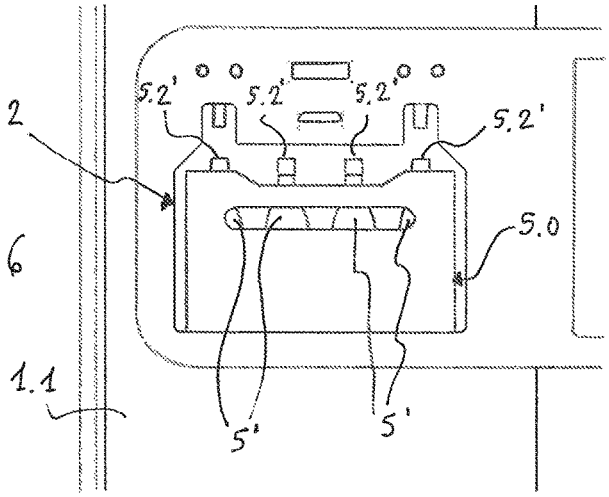

FIG. 16 is a detail of the drawing station of the dispenser of FIG. 13, whereon the case of the plurality of containers of FIG. 14 is placed.

Figure 17:
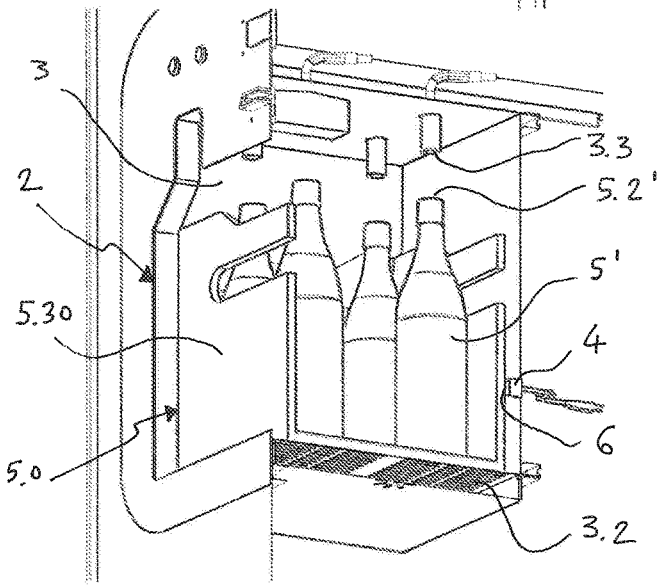

FIG. 17 shows a perspective front-side section of the case of the plurality of containers when placed in the drawing station of the dispenser of FIG. 13.

The features of the invention shall now be described using the reference numerals contained in the figures and with particular reference to the variants represented therein.

It is also noted that any dimensional and spatial term (such as "lower", "upper", "inner", "outer", "front", "rear" and the like) refers to the position according to which the elements of the invention are shown in the annexed figures, without any limiting intent relative to the possible operating conditions.

Reference numeral 1 indicates the dispenser for dispensing beverages, comprising a containment and support structure 1.1 which, in the example of the annexed figures, appears as a box-shaped element having a substantially parallelepiped shape; however it can take the most varied architectural configurations, in consideration of the intended environment and of the requirements related to the type of use.

Said structure 1.1 defines an inner volume adapted to accommodate the standard construction-functional components of a dispenser (hydraulic circuitry and tanks, refrigeration and gasification units, sanitisation elements), that do not require a thorough discussion as they are part of the prior art in the field.

In said structure 1.1 there are also obtained the typical user interface components, suitable for dispensing water and for using any accessory elements.

They comprise:

- at least a drawing station 2 (described shortly in greater detail, as it is strictly related to the object of the present invention),
- selection controls for the various options (e.g. type and quantity of the beverage to be dispensed),
- a display or information display for displaying the selected options.

In the non-limiting example, shown in the annexed figures, said selection controls of the various options and the display are incorporated into a single component, i.e. into the monitor 1.3 located in the upper portion 1.2 of the structure 1.1.

Preferably, said monitor 1.3 is of the touch screen type, adapted both to the selection and display of the choice made, besides the broadcasting of multimedia contents (e.g. advertisements, entertainment movies, video demonstrations on the proper use of the dispenser): even this aspect will be described in details hereinafter, because as well related to the present invention.

It is however understood that the features of the invention herein described may found suitable application also in dispensers devoid of monitors or also of the same selection controls, as shall be explained hereinafter.

Likewise, it will be clear shortly that it is even not mandatory the presence of a device for the insertion and acceptance of currency (where "currency" refers to both the current currency in use and other means of payment, such as credit card, prepaid card, or microchip key), usually available on the prior art dispensers.

The drawing station 2 comprises a compartment 3 obtained inside the structure 1.1 of the dispenser and having suitable dimensions to house a container 5 to fill with the dispensed beverage.

In the example of the annexed FIGS. 1 to 10.B, such container 5 consists of a bottle or flask, but obviously what said herein applies to any container having such a shape and dimensions as to be placed in the compartment 3 of the drawing station 2.

Said compartment 3 is provided with a base 3.1 for supporting the container 5, preferably provided with a grid 3.2 (or similar surface provided with openings) for the drainage of any beverage escaping from the container or dripping from the dispensing spout 3.3.

According to the present invention, the container 5 and the compartment 3 are provided with reciprocal centring elements, having the purpose of allowing the correct positioning of said container 5 inside the drawing station 2.

According to a first variant of the invention (as shown in FIGS. 1 to 4.B), a pin 4 projects from said base 3.1, the main function whereof (but not exclusive, as explained hereinafter) is to act as positioning and centring element for the container 5, as it is intended to engage with a cavity 6 of reciprocal shape, present on the bottom 5.1 of said container 5 (see FIGS. 3.A and 3.B).

In fact, said pin 4 is aligned with the overlying spout 3.3 dispensing the beverage (or better, it is vertically aligned with at least one opening wherefrom said beverage comes out), therefore the coupling with cavity 6 of the container 5 ensures the correct alignment of the mouth 5.2 of the container 5 with the liquid flow, providing assurance that the latter is precisely directed inside said container 5.

Actually, according to a more generic variant of the invention, said pin 4 may also not be vertically aligned with such opening 3.3 dispensing the beverage; the important is that the mouth 5.2 of the container 5 is, once the latter is coupled to said pin 4 through the said cavity 6: in other words, said pin 4 may also erect from the base 3.1 from a point not aligned with the overlying opening 3.3, providing that also the cavity 6 of the container 5 is, and that, once the coupling has taken place, the mouth 5.2 of said container 5 is aligned with the flow of the beverage: in conclusion, by "reciprocal centring means" it is meant coupling means suitable for the correct alignment of the mouth 5.2 of the container 5 with the overlying opening 3.3 for dispensing the beverage.

According to another variant of the invention (shown in FIGS. 6.A and 6.B), the centring element 6 of the container 5 is positioned on the rear side 5.3 of said container 5 and is intended to couple with a reciprocal centring element 4 projecting from the rear wall of the compartment 3 of the drawing station 2.

In said variant, such centring element 6 is placed on the rear side surface 5.3 of the container; it is adapted to couple by contact with the centring element 4 of the compartment 3, in particular consisting of a pin coming out from the rear wall of said compartment 3 (see FIG. 6.B).

However it is obviously possible that said reciprocal centring elements 6 and 4 take different dimensional and spatial shapes from those shown in figure, while keeping the fundamental requirement of their reciprocal coupling ability, in order to obtain the desired and correct allocation of the container 5 in the drawing station 2 (that is, the correct alignment of the mouth 5.2 of the container 5 with the overlying spout or opening 3.3 for dispensing the beverage).

For example, the centring element 6 of the container 5 may consist of a pin projecting from the rear side 5.3 of such container 5, engaging in a cavity on the rear wall of compartment 3, which acts as a centring element 4 of said compartment 3.

It is equally possible the case that said centring element 6 of the container 5 and said centring element 4 of compartment 3 are obtained, respectively, on the lateral side 5.3 of said container 5 and on a side wall of said compartment 3 of the drawing station 2; or, respectively, on the bottom 5.1 of such container 5 and on the base 3.1 of said compartment 3 (as already provided in the variant of FIGS. 1 to 4.B).

In conclusion, to achieve the purpose of the correct placement of the container 5 in the compartment 3, it is necessary and sufficient that said centring elements 4 and 6 have suitable reciprocal shape, i.e. have shape, size and spatial placement on the respective container 5 and compartment 3 such as to achieve a bi-univocal coupling, through insertion by interference or contact positioning.

FIGS. 7 and 8 show a further variant of the present invention, wherein the centring element 6 is obtained on the shoulder 5.4 of the container 5, i.e in the portion between the side 5.3 and the neck 5.5 of said container 5: in the specific example, said centring element 6 takes the shape of a pin section projecting from said shoulder 5.4 (in rear position, as shown in figure, or alternatively lateral) and is adapted to couple by contact with the centring element 4 of compartment 3, consisting of a pin emerging from the wall (respectively rear, as shown in figure, or alternatively lateral) of said compartment 3 and having reciprocal shape to that of the centring element 6 of the container 5.

According to such variant, said centring element 4 is provided on top with a bi-forked hook 4.3, acting as a seat for the neck 5.5 of the container 5, as shown in FIG. 8.

Said hook 4.3, in conclusion, represents a further means to ease the user in the correct positioning of the container 5 inside the drawing station 2 and ensure the reciprocal coupling between the respective centring elements 6 and 4 of the container 5 and compartment 3.

The coupling between such centring elements 6 and 4, through reciprocal insertion by interference or contact positioning (in accordance to the different shape variants described above) allows the user of dispenser 1 to place the container 5 inside compartment 3 of the drawing station 2 in a suitable position so that said container 5 may receive the dispensed beverage.

In fact, as shown in FIGS. 4.A, 4.B, 6.A, 6.B and 7, once the reciprocal coupling between the centring element 6 on the container 5 and the centring element 4 on compartment 3 has taken place, the mouth 5.2 of said container 5 is found to be in alignment with the overlying spout 3.3 dispensing the beverage (or better, is vertically aligned with at least a spout or opening 3.3 wherefrom said beverage comes out), ensuring that the liquid flow is precisely directed inside said container 5.

For the purpose just mentioned of centring and positioning the container 5 another advantage is added, both aesthetic and functional-hygienic: the perfect centring of the mouth 5.2 of the container 5 in the compartment 3, precisely in alignment with the flow of the dispensed beverage, allows the spout 3.3 not to be accessible at all to the users (minimizing the risk of vandal tampering or anti-hygienic events) nor visible (being it even possible to be absent and the beverage escaping from a simple opening 3.3 obtained in the summit wall of compartment 3, in communication with the pipe for emitting the liquid).

The reciprocal coupling between said centring elements 6 and 4 may be rotationally free, allowing the positioning of the container 5 in compartment 3 according to any direction: this occurs when the centring element 6 of the container 5 and the centring element 4 of compartment 3 have the shape of a solid of rotation, such as a cylinder (as shown in FIGS. 1 to 4.B) or a cone (as shown in FIG. 5.B, illustrating a variant of container 5 intended to be used in combination with a suitable dispenser 1 having a compartment 3 wherefrom a conical pin 4 projects).

As an alternative, the shape of said centring elements 6 and 4 may be that of a prismatic and/or curvilinear asymmetric solid, so that the positioning of the container 5 is mandatory according to a single and precise direction.

FIGS. 5.A and 5.C show two variants in that direction, with the container 5 on the bottom 5.1 whereof a cavity 6 is obtained intended to engage with a pin 4 having the shape of a drop or trapezium (in such case the term "pin" is improper, but is to be intended in general as a "projection" or "protruding element") (other variants may consist of a polyhedron with a base of another asymmetric shape): therefore the container 5, keeping unchanged the advantages of the correct positioning in alignment with the beverage flow, may be however inserted on pin 4 in a single direction.

The same result may be obtained with the variants illustrated in FIGS. 6.A, 6.B, 7 and 8, wherein the reciprocal coupling between the respective centring means 6 and 4 require a single and precise insertion direction of the container 5 in the compartment 3.

Such configuration enables to know with certainty which portion of the container 5 is oriented towards the users, so as to use it for applying logos, brands and/or advertising messages; at the same time, such device allows to obtain dispensers 1 and containers 5 intended solely to well determined recipients, avoiding the mixture in the use with unauthorised persons and denoting such products with exclusivity and value qualities from the commercial point of view.

According to a further variant of the invention (shown in FIGS. 9.A, 9.B, 10.A and 10.B, illustrating only some of the above mentioned variants), the container 5 is also provided with a suitable portion 5.6 of transparent surface, at least at the area whereat its centring element 6 is placed.

Said portion 5.6 of transparent surface, which preferably extends crosswise up to the front side 5.3 of the container 5 (i.e. that immediately more visible by the user), allows the user of dispenser 1 to visually monitor the correct coupling of the centring element 6 with the reciprocal centring element 4 of compartment 3 of the drawing station 2.

Moreover, according to such variant, the said centring element 4 of compartment 3 is further provided with at least a light source (not shown in figure), preferably one or more leds, the lighting, colouring and frequency thereof are indicative of different operating steps of the dispenser 1: as a result, once the container 5 has been correctly positioned in compartment 3 (through the above coupling between the reciprocal centring elements 6 and 4) said one or more leds activate and their light output can be easily observed by the user thanks to the portion 5.6 of transparent surface of which said container 5 is provided.

For example a steady green light source may mean that the dispenser 1 is working and ready to receive the container 5; a blue light source may indicate that the correct coupling between the container 5 and compartment 3 has taken place, while a pulsating blue light source may identify the dispensing step of the beverage by the dispenser 1; or, a steady red light source may mean a malfunction of the dispenser 1, while a pulsating red light source may mean that said container 5 has not been recognised or an incorrect coupling between said container 5 and the dispenser 1.

The variants described so far refer to a dispenser 1 having a drawing station 2 of such dimensions as to allow placing only one container 5; in the case of larger drawing stations 2 and intended for a plurality of containers 5, as many pair of reciprocal centring elements 6 and 4 as the number of containers 5 to allocate in the compartment 3 may be present, so that the mouths 5.2 of said containers 5 are vertically aligned with as many outlet spouts 3.3 of the beverages.

As an alternative, always with reference to the case of larger drawing stations 2 and adapted to receive more than one container 5, the positioning of one or more cases 5.0 (typically a basket) may be provided, wherein a plurality of containers 5' is placed: in that case the above one or more cases 5.0 are provided with centring elements 6, adapted to couple with reciprocal centring elements 4 of the compartment 3 of said drawing station 2, so that the mouths 5.2' of said plurality of containers 5' arranged inside said one or more cases are vertically aligned with the spouts 3.3 dispensing the beverage.

More precisely, as shown in FIGS. 13 to 17 (wherein a dispenser 1 comprising two drawing stations 2 is illustrated), the case 5.0 and the compartment 3 are provided with reciprocal centring elements, with the main purpose of allowing the correct positioning of said case 5.0 inside the drawing station 2.

According to another variant of the invention shown in such figures, the centring element 6 of the case 5.0 is positioned on the rear side 5.30 of said case 5.0 and is intended to couple with a reciprocal centring element 4 projecting from the rear wall of compartment 3 of the drawing station 2.

In the illustrated variant, such centring element 6 is placed on the rear side surface 5.30 of the case 5.0; it is adapted to couple by contact with the centring element 4 of compartment 3, in particular consisting of a pin projecting from the rear wall of said compartment 3.

However, totally similar to what described for the variants relative to the single container 5, it is of course possible that said reciprocal centring elements 6 and 4 take dimensional and spatial shapes that are different from those shown in the figure, still maintaining the fundamental requirement of their reciprocal coupling ability, in order to obtain the desired and correct allocation of the case 5.0 in the drawing station 2.

For example, the centring element 6 of the case 5.0 may consist of a cavity wherein the centring element 4 engages; or, viceversa, said centring element 6 may consist of a pin projecting from the rear side 5.30 of the case 5.0, engaging in a cavity on the rear wall of compartment 3, which acts as a centring element 4 of said compartment 3.

It is equally possible the case that said centring element 6 of the case 5.0 and said centring element 4 of compartment 3 are obtained, respectively, on the lateral side 5.30 of said case 5.0 and on a side wall of said compartment 3 of the drawing station 2; or, respectively, on the bottom 5.10 of such case 5.0 and on the base 3.1 of said compartment 3.

In conclusion, to achieve the purpose of the correct placement of the case 5.0 in compartment 3, it is necessary and sufficient that said centring elements 4 and 6 have suitable reciprocal shape, i.e. have shape, size and spatial positioning on the respective case 5.0 and compartment 3 such as to obtain a bi-univocal coupling, through the insertion by interference or contact positioning.

The coupling between such centring elements 6 and 4, through reciprocal insertion by interference or contact positioning (in accordance to the different shape variants described above) allows the user of dispenser 1 to place the case 5.0 inside compartment 3 of the drawing station 2 in a suitable position so that the plurality of containers 5' placed inside said case 5.0 may receive the dispensed beverage.

In fact, as shown in FIGS. 16 and 17, once the reciprocal coupling between the centring element 6 on the case 5.0 and the centring element 4 in compartment 3 has taken place, the mouths 5.2' of said containers 5' contained in said case 5.0 are found to be aligned with the overlying spouts 3.3 dispensing the beverage, ensuring that the liquid flow is precisely directed inside the said containers 5' (obviously, to obtain this condition, the correct placement of the plurality of containers 5' inside said case 5.0 is required, obtainable with mechanical or visual positioning means, which have long been used in the common baskets and, in general, in container collectors for beverages).

According to a variant of the invention, not shown in the figure but similar to what provided for the variants relative to the container 5 alone, the case 5.0 may be equipped with a suitable portion of transparent surface, at least at the area wherein its centring element 6 is placed.

Said portion of transparent surface, which preferably extends crosswise up to the front side 5.30 of the case 5.0 (i.e. that immediately more visible by the user), allows the user of dispenser 1 to visually monitor the correct coupling of the centring element 6 with the reciprocal centring element 4 of compartment 3 of the drawing station 2.

Moreover, according to such variant, the said centring element 4 of compartment 3 may be further provided with at least a light source, preferably one or more leds, the lighting, colouring and frequency thereof may be indicative of different operating steps of the dispenser 1: as a result, once the case 5.0 has been correctly positioned in compartment 3 (through the above coupling between the reciprocal centring elements 6 and 4), said one or more leds activate and their light output can be easily observed by the user thanks to the portion of transparent surface of which said case 5.0 is provided.

For example a steady green light source may mean that the dispenser 1 is working and ready to receive the case 5.0; a blue light source may indicate that the correct coupling between the case 5.0 and compartment 3 has taken place, while a pulsating blue light source may identify the dispensing step of the beverage by the dispenser 1; or, a steady red light source may mean a malfunction of the dispenser 1, while a pulsating red light source may mean that said case 5.0 has not been recognised or an incorrect coupling between said case 5.0 and the dispenser 1.

The variants illustrated in FIGS. 13 to 17 show drawing stations 2 of such dimensions as to allow placing only one case 5.0; in the case of larger drawing stations 2 and intended for a plurality of cases 5.0, as many pair of reciprocal centring elements 6 and 4 as the number of cases 5.0 to place in the compartment 3 will be present, always in such a way as to ensure that the mouths 5.2' of the plurality of containers 5' placed in said cases 5.0 are vertically aligned with as many outlet spouts 3.3 of the beverages.

From the above description it is therefore clear that a feature of the present invention is to enable the correct allocation in compartment 3 of the drawing station 2 of dispenser 1 of a container 5 to be filled or a case 5.0 containing multiple containers to be filled.

The coupling between the centring elements 4 and 6 of, respectively, compartment 3 and container 5 (or, similarly, of compartment 3 and case 5.0), besides the positioning task described above, is functional to a further feature of the present invention.

Such feature shall be hereinafter described with reference to the variant related to the reciprocal coupling alone between the single container 5 and compartment 3, therefore with reference to the combination between the dispenser 1 and the container 5 of FIGS. 1 to 10.B: however, what described applies exactly also to the variant relative to the reciprocal coupling between compartment 3 and case 5.0 of a plurality of containers 5', that is the combination between the dispenser 1 and the case 5.0 of FIGS. 13 to 17.

Said further functional feature consists in that a microchip 7 is present on the centring element 6 of the container 5, fixed therein by co-moulding or gluing.

Said microchip 7 typically consists of an integrated circuit or an RFID (Radio Frequency IDentification) label (also referred to as "tag" or "transponder"); as an alternative, the microchip may comprise an NFC (Near Field Communication) electronic element, or, in any case, any electronic apparatus capable of storing data in its memory and communicating wirelessly with a suitable component described shortly.

For convenience of description, such element located on the centring element 6 shall be generically referred to as "microchip 7".

The wireless communication technologies just described have long been used in many fields; without detailing their operation nor the components widely known to any man skilled in the art, it suffices to say that they comprise at least the following elements:

- the above mentioned microchip 7, provided with non-volatile memory wherein data is stored,
- an antenna to send and receive signals from and to said microchip 7: such antenna is usually integrated to the same microchip through a physical support substrate (typically consisting of plastic film), or placed in close proximity,
- a reading/writing device, communicating with such microchip 7 and capable of querying, writing and updating the information contained in said microchip 7,
- an information system for the management of data exchanged between the above mentioned microchips 7 and the reading/writing device.

In the dispenser 1 of the present invention, said reading/writing device (hereinafter generally referred to as "reader", although it is also capable of writing data) is identified with the reference numeral 4.1 and is located in the centring element 4 of compartment 3 of the drawing station 2.

As per prior art of the above mentioned radio-frequency technologies, the reader 4.1 is technically capable of communicating remotely with the microchip 7 located in the centring element 6 of container 5: however, according to the present invention, this exchange of information occurs only and exclusively when the coupling between the centring elements 4 and 6 is achieved, that is when the container 5 is correctly inserted in the drawing station 2 and the contact between the microchip 7 (located in said centring element 6 of container 5) and the reader 4.1 (placed in said centring element 4 of compartment 3) is obtained. Said result is preferably achieved by means of a suitable calibration of the radio-frequency transmission system with the use of microchips 7 with a well defined operating frequency band: in detail, the so called HF (High Frequencies) microchips at 13.56 MHz may be calibrated so as to be capable of communicating with the reading/writing device only at a very short distance, with a gap of max. 1-2 cm between the reader 4.1 and the microchip 7.

As an alternative or in combination with the previous solution, the correct communication between the two elements may be enabled with sensor or mechanical elements (not shown in figure), for example a contrast pin or a proximity sensor inserted in at least one of the centring elements 4 and 6, capable of verifying that the coupling has taken place and thus authorizing the communication between said microchip 7 and the reader 4.1.

As said above, the system is completed by an electronic device for the management of data exchanged between the microchip 7 and the reader 4.1.

Said device typically comprises a central processing unit (hereinafter abbreviated with the term "CPU"), incorporated in the structure 1.1 of the dispenser 1 and directly connected to the reader 4.1 through connecting means 4.2.

Said CPU is preferably but not mandatorily connected to a display, in particular monitor 1.3 integrated to the dispenser 1.

Moreover, always preferably, the CPU is provided with Internet connection in order to interface with one or more system central processors (hereinafter briefly referred to as "servers"), optionally capable of containing all the information and data which shall be described shortly by way of an example.

According to the invention, when the container 5 is correctly placed in compartment 3 of the drawing station 2 (obtaining the coupling between the respective centring elements 6 and 4), the wireless system just described starts and the dispenser 1 can read the content of the microchip 7, activating a series of services of an information and functional nature according to the data contained therein.

Of course, for this to happen, a preparatory step is necessary in which the entering of predetermined data in the microchip 7 of container 5 takes place; such a task may be carried out with different times and methods, alternative or combined to each other, as summarised hereinafter:

- at the time of the first purchase or collection of said container 5: the microchip 7 is coded with a series of data provided by the user (directly by the same user or by the persons in charge of selling/supplying said container 5), by means of a suitable portable reader; or
- and/or at the time of first use of the container 5 in the dispenser 1: data selected by the user is entered in the microchip 7 that is still virgin directly by the latter by means of an interface software which can be displayed in the monitor 1.3 connected to the CPU which, in turn, sends the data entered to the reader 4.1 (operating in "reading" mode) to code it on microchip 7; or
- and/or during the normal use of container 5: data initially entered in microchip 7 with one of the two methods described above, are periodically modified or overwritten, by the same user or by the persons in charge for selling/supplying the container 5, by means of the said portable reader or through a monitor 1.3 interface of the dispenser 1.

In the methods in which it is the same user to act on the content of microchip 7 of the container 5 through the monitor interface 1.3, it is of course necessary the presence of this last component in the structure 1.1 of the dispenser 1.

In the other methods of entering and managing the content of microchip 7 of the container 5 (i.e. with such microchip 7 already coded originally or overwritten subsequently, by means of the portable reader), the dispenser 1 may be devoid of the monitor 1.3 and the reader 4.1 operates only in reading mode, since it is not possible for the user to write or overwrite data in microchip 7 through the interface software: however the wireless communication system between the container 5 and the dispenser 1 is fully operational and capable of providing the user with the majority of functional and informational services, related to the type of data entered in such microchip 7.

By way of a non limiting example, some types of information that can be entered in microchip 7 of container 5 and the additional functions deriving from the recognition of said container 5 (and, as a result, of the user owing the same) by the dispenser 1 are listed below:

- data relative to the money credit available for the use of the beverage dispensing service: if sufficient, the dispenser 1 may proceed directly to dispense the liquid without the need for the user to use the currency acceptance device (which, therefore, may also be absent);
- data identifying the tastes and choices of the user owner of the container 5, concerning the type and quantity of the beverage to distribute: the dispenser 1 may therefore dispense directly the type and predetermined quantity of beverage according to the instructions previously selected by the user and coded in microchip 7;
- data relative to the personal preferences of the user owner of the container 5, concerning fields non purely related to the dispensing function of the dispenser 1 but in any case enabling informative-recreational services which can be used during the use of the dispenser 1: viewing of multimedia content (images, movies, texts, music) on monitor 1.3, selected among the content previously loaded in the CPU or downloaded from the server through the Internet connection;

data of health-alimentary nature and/or related to sport activities of the user owner of the container 5: the dispenser 1 may dispense beverages added with dietary supplements or vary their type according to a calendar (seasonal, weekly, daily or hourly), completed by the user and coded in the microchip 7.

As said above, the wireless system starts at the time that the container 5 is correctly placed in the drawing station 2 (obtaining the coupling between the respective centring elements 6 and 4): in the case already mentioned where said container 5 is provided with a suitable portion of transparent surface (at least at the area where its centring element 6 is placed) and the centring element 4 of said compartment 3 is provided with at least a light source (preferably one or more leds), the user is given the possibility to visually monitor the different operating steps of such wireless system, each of which is associated to a different lighting, colouring and frequency of such light source.

For example, a steady green light source may indicate that the correct activation of the wireless communication system between the container 5 and the dispenser 3 has taken place, while a pulsating white light source may indicate the step of supplying services of an information and functional nature; or, again, a black light source may mean a malfunction of the wireless system or the absence of money credit available for using beverage dispensing service.

As mentioned above, besides being directly insertable on site through the monitor 1.3 of the dispenser 1 and relative interface software communicating with CPU and the reader 4.1, such types of data may be entered in the microchip 7 of container 5 by means of a portable reader, which can be used at home by the user or available to the persons in charge of selling/supplying the containers 5.

FIG. 11 shows said portable reader, identified with reference numeral 8 and substantially reproducing the same components of the base 3.1 of the drawing station 2 of dispenser 1 according to the variant of FIGS. 1 to 4.B.

In fact, it comprises a base 8.1 for supporting the container 5, provided with a pin 9 having the shape corresponding to that of cavity 6 with which it is intended to couple.

In case the container 5 has a cavity 6 of different shape, such portable reader 8 shall obviously have a pin 9 of reciprocal shape, intended for engaging in said cavity 6.

Said pin 9 incorporates the reader 9.1, adapted to operate both in reading and writing mode of the microchip 7, located on the bottom 6.1 of the cavity 6 of the container 5.

The insertion of the container 5 on said reader 8 activates the wireless system for the communication between the microchip 7 and the reader 9.1, with the user who may therefore enter, update or overwrite data. The operation of entering said data takes place after connecting (wireless or wired, for example through cable 8.2 for the connection with the USB socket, shown in the figure) the portable reader 8 to a personal computer, hand held device, tablet or smartphone, operating on a suitable interface software between the user and such reader 8.

Even the various operating steps of the portable reader 8 (power on, reading, writing, malfunctioning) may be associated to one or more identification leds, visually monitorable by the user: said one or more leds may be arranged on top of the pin 9 and, for this purpose, the lower portion of the container 5 is transparent.

The above mentioned management software (operating without distinction off-line locally or online via Web) is, therefore, intended for coding the microchip 7 of the specific container 5 located on the portable reader 8, providing the user with an interface for entering the desired data and associate it to the container 5 to be used in the dispenser 1.

Moreover, the same software has an optional function which allows sending coded information to a server, according to the typical encryption and confidentiality standards of personal information, which has long been used in processor programs: this option, even if not affecting the general operation of the communication system between the single container 5 and the dispenser 1, is useful for the central processing, for statistical purposes, of data entered in the microchip 7 over the time, besides acting as a security archive which the dispenser 1 can use remotely in case of malfunctioning of the microchip 7 of the specific container 5.

The software examined may also allow the online recharge of the money credit available on the specific container 5, according to the usual standards of virtual payment via Web: in such case the remote connection function of the software (both that usable through the portable reader 8 and that usable through the monitor 1.3 of the dispenser 1) to a server becomes mandatory, as the credit institution has to manage the crediting and debiting steps via Internet.

As it is clear from the above description, the combination between the dispenser 1 and the container 5 allows the intended objects to be achieved and a series of advantages relative to the prior art beverage dispensers to be obtained.

The first order of advantages is related to the possibility of precisely positioning the container 5, with its mouth 5.2 aligned exactly with the flow of the dispensed beverage, thanks to the coupling between the respective centring elements 6 and 4 of said container 5 and compartment 3, speeding up and easing the use of the container 5 and dispenser 1 by the user.

A second order of advantages lies in the wireless communication system between the container 5 and the dispenser, with the container 5 acting as an actual personal instrument of the user for activating additional services of an information and functional nature, still usable through the dispenser 1.

In relation to this last order of advantages it is also possible to provide that the same container 5 may be used to activate other services not related to the use of the dispenser 1 but of other public services, such as for example the use of car parks or rental of public means: of course the coupling and wireless communication system between the centring means 6 of container 5 (and related microchip 7) and the centring means 4 (and relative reader 4.1) of which structures for dispensing and authorising such additional services must be provided, remains unchanged.

The invention claimed is:

1. Combination of a dispenser for dispensing beverages with at least a container for beverages, the container having a mouth and a container centering element said dispenser comprising:

a containment structure and at least one drawing station, having:

a compartment disposed within said structure, adapted to the placement of said at least one container to be filled, a base for supporting said at least one container, at least one opening or spout for dispensing beverages, overlying said base, at least one dispenser centering element reciprocal of the container centering element, wherein reciprocal coupling between said container and dispenser centering elements enables the positioning of said container in said compartment such that the mouth of said container is vertically aligned with said overlying opening or spout for dispensing the beverages, wherein said reciprocal coupling activates a communication system for the exchange of data between said container and said dispenser, said communication system comprising:

a reader located in said dispenser centering element, a microchip provided with non-volatile memory for the storage of said data, an antenna disposed in said dispenser centering element adapted to receive signals from said microchip and transfer said signals to said reader, an information system for the management of data exchanged between said reader and microchip, said communication system performing said exchange of data responsive to said reciprocal coupling.

2. Combination between a dispenser and a container according to claim 1, wherein said reciprocal coupling comprises insertion of one reciprocating element into the corresponding reciprocating element.

3. Combination between a dispenser and a container according to claim 2, wherein, said container centering element comprises a projecting pin adapted to engage in said dispenser centering element, and wherein said dispenser centering element comprises a cavity.

4. Combination between a dispenser and a container according to claim 2, wherein said container centering element comprises a cavity adapted to engage with said dispenser centering element, and wherein said dispenser centering element comprises a projecting pin.

5. Combination between a dispenser and a container according to claim 1, wherein said reciprocal coupling between said centering elements comprises contact positioning.

6. Combination between a dispenser and a container according to claim 5, wherein said container centering element is disposed on the surface of the rear or lateral side of said container and is adapted to couple with said dispenser centering element, said dispenser centering element comprising a pin projecting from the rear and lateral wall of said compartment respectively.

7. Combination between a dispenser and a container according to claim 5, wherein said container centering element comprises a pin section placed on a shoulder in a rear or lateral position, of said container and is adapted to couple with said dispenser centering element, which comprises a pin projecting from the rear and lateral wall of said compartment respectively.

8. Combination between a dispenser and a container according to claim 7, Further comprising a bifurcated hook dimensioned to seat a neck portion of said container, wherein said pin of said dispenser centering element being coupled to the bifurcated hook.

9. Combination between a dispenser and a container according to claim 1, wherein said container centering element is visible therethrough, said dispenser centering element having at least one light source, operable in response, said reciprocal coupling, such that light emanating from said light source being visible through said transparent portion, whereby the light source is indicative of at least one condition selected from a group consisting of correct coupling taken place, operating steps of said dispenser, operating steps of said communication system, and any combination thereof.

10. Combination between a dispenser and a container according to claim 9, wherein said portion of transparent surface extends up to the front side of said container.

11. Combination between a dispenser and a container according to claim 1, wherein said microchip is fixed by co-moulding or gluing to said container centering element.

12. Combination between a dispenser and a container according to claim 1, wherein said antenna is integrated to said container centering element, proximal to said microchip.

13. Combination between a dispenser and a container according to claim 1, wherein said microchip consists of an integrated circuit or an RFID or NFC label.

14. Combination between a dispenser and a container according to claim 1, wherein said microchip comprises a label operating at 13.56 MHz, said microchip being calibrated to communicate with said reader only at a distance of between 0-2 cm.

15. Combination between a dispenser and a container according to claim 1, further comprising a sensor or mechanical element disposed in the dispenser centering element, the container centering element or in a combination thereof, the sensors of mechanical elements being adapted to verify the occurrence of reciprocal coupling and subsequently to authorizer the activation of said communication system.

16. Combination between a dispenser and a container according to claim 1, wherein said communication system further comprising a CPU and a monitor integrated to said dispenser.

17. Combination between a dispenser and a container according to claim 1, further comprising an Internet data link.

18. Combination between a dispenser and a container according to claim 17 wherein the communications system is farther configured to deliver at least one service of an informational nature, a functional nature, or a combination thereof, responsive to the information of said exchanged data.

19. Combination between a dispenser and a container according to claim 18, wherein said data stored in said microchip are wholly or partially editable and can be overwritten via a portable reader, via said dispenser, or individually by both a portable reader and the dispenser.

20. Combination between a dispenser and a container according to claim 17, wherein said data or a portion thereof is storable in said microchip either at the time of the first purchase or collection of said container, or at the time of the first use of said container with said dispenser.

21. Combination between a dispenser and a container according to claim 1, wherein the data being exchanged comprises of at least one information item selected from a list consisting of the container user information, the container owner information, credit balance, beverage type preference, beverage quantity preference, personal activity of the container user, or any combination thereof.

22. Combination between a dispenser and a container according to claim 1, wherein said antenna is further adapted to receive signals from said reader and transfer said signal to said microchip.

23. Combination between a dispenser and a container according to claim 1, wherein said microchip is disposed in said container centering element.

* * * * *